US006053523A

United States Patent [19]

Quillard et al.

[11] Patent Number: 6,053,523

[45] Date of Patent: Apr. 25, 2000

[54] SAFETY BINDING FOR THE FRONT END OF A BOOT

[75] Inventors: Frédéric Quillard, Nevers; Jean-Louis Chevalier, Varennes Vauzelles, both of France

[73] Assignee: Look Fixations S.A., Nevers, France

[21] Appl. No.: 09/021,730

[22] Filed: Feb. 11, 1998

[30] Foreign Application Priority Data

Feb. 20, 1997 [FR] France ..... 97 02249

[51] Int. Cl.[7] ..... A63C 9/08

[52] U.S. Cl. ..... 280/625; 280/629; 280/634

[58] Field of Search ..... 280/623, 624, 280/625, 629, 630, 633, 634, 636; 16/225

[56] References Cited

U.S. PATENT DOCUMENTS

| | | | |
|---|---|---|---|
| 4,431,210 | 2/1984 | Nitschko | 280/625 |
| 4,919,259 | 4/1990 | Beaulieu | 16/225 |
| 4,974,869 | 12/1990 | Muhlberger et al. | 280/625 |
| 5,205,575 | 4/1993 | Wladar | 280/625 |
| 5,328,201 | 7/1994 | Wladar | 280/625 |
| 5,333,892 | 8/1994 | Stritzl et al. | 280/625 |
| 5,879,020 | 3/1999 | Buquet | 280/633 |

FOREIGN PATENT DOCUMENTS

| | | | |
|---|---|---|---|
| 0295372 | 12/1988 | European Pat. Off. . | |
| 0303026 | 2/1989 | European Pat. Off. . | |
| 432407 | 6/1991 | European Pat. Off. | 280/634 |
| 2488140 | 2/1982 | France | 280/625 |
| 3004529 | 9/1980 | Germany | 280/634 |
| 3151767 | 7/1983 | Germany | 280/634 |

*Primary Examiner*—J. J. Swann
*Assistant Examiner*—F. B. Vanaman
*Attorney, Agent, or Firm*—Bugnion S.A.; John Moetteli

[57] ABSTRACT

Jaw-type binding consisting of two arms (5, 6) which are mounted in order to pivot independently and forming a lever acting on the end of a rod (12), the other end of which is connected to a stop (14) which is secured to the rod and is retained by a spring (16) whose preload can be adjusted by moving the stop, on which there is an index (15) cooperating with a graduation (22) on a plate (20). The front end of this plate bears elastically (24, 25) against the body (3) of the binding, so as to follow movement of the rod when the boot is engaged, in such a way that the display of the preload of the spring is not modified by the engagement of the boot.

2 Claims, 2 Drawing Sheets

FIG.1
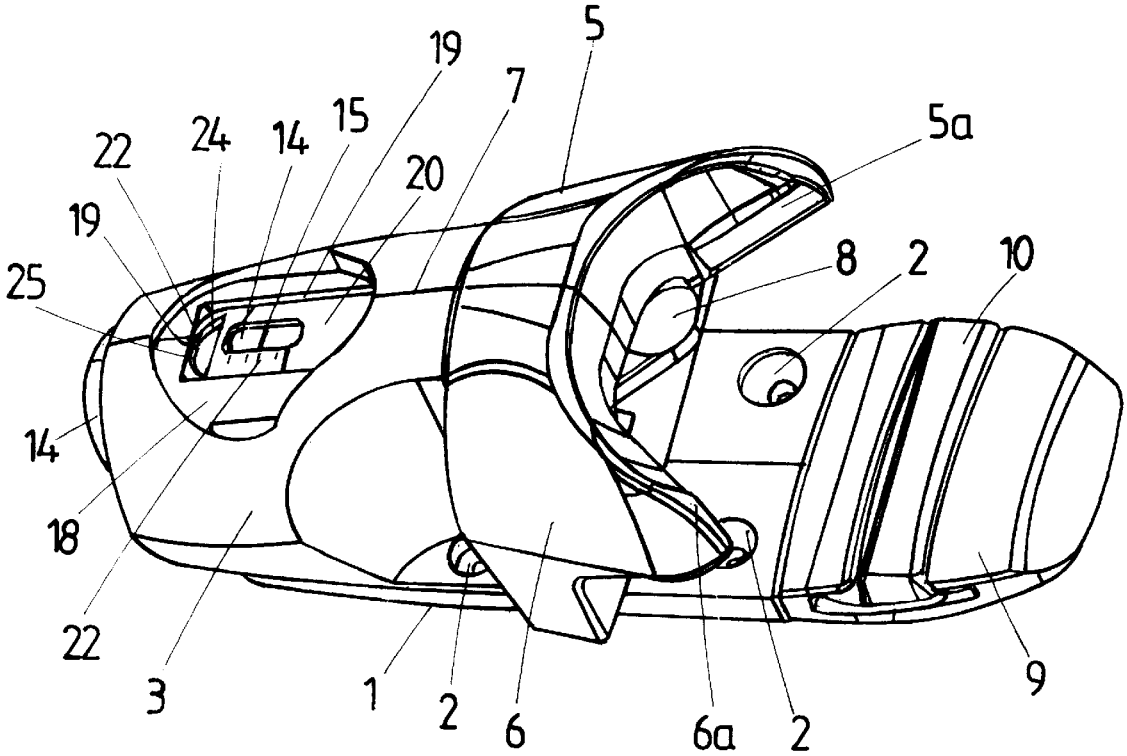
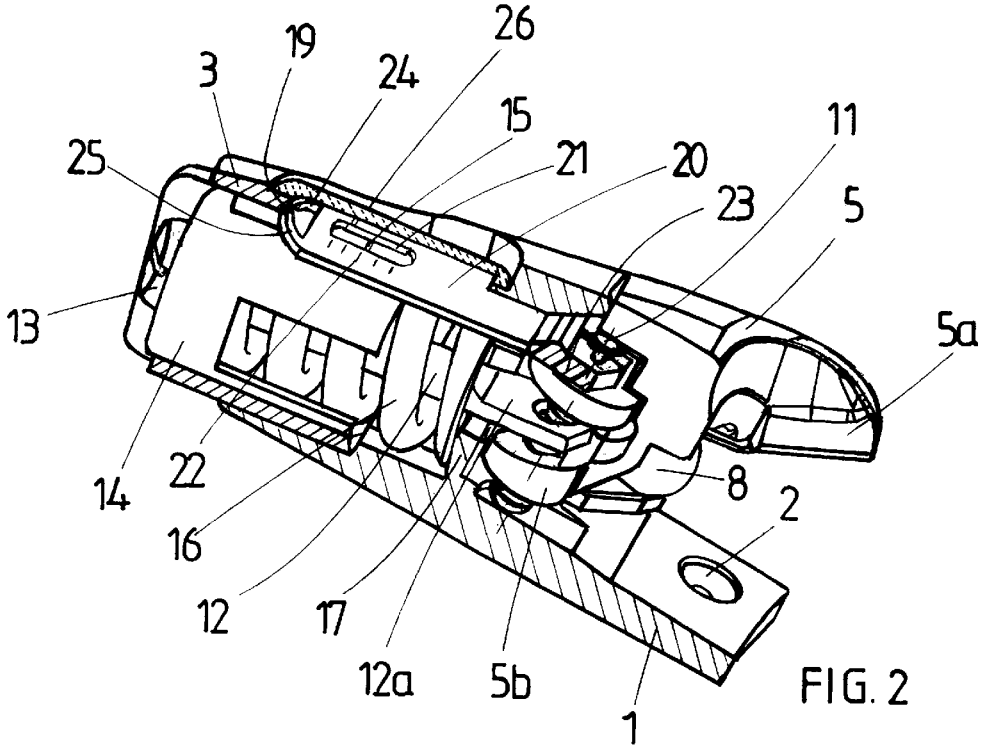
FIG. 2

Fig.3
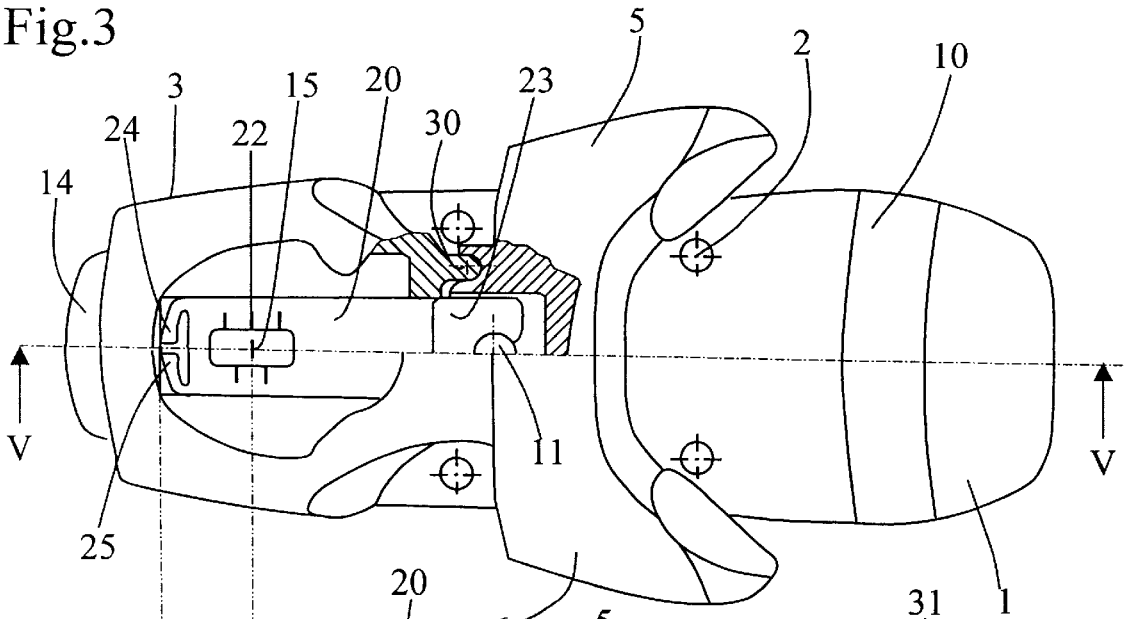
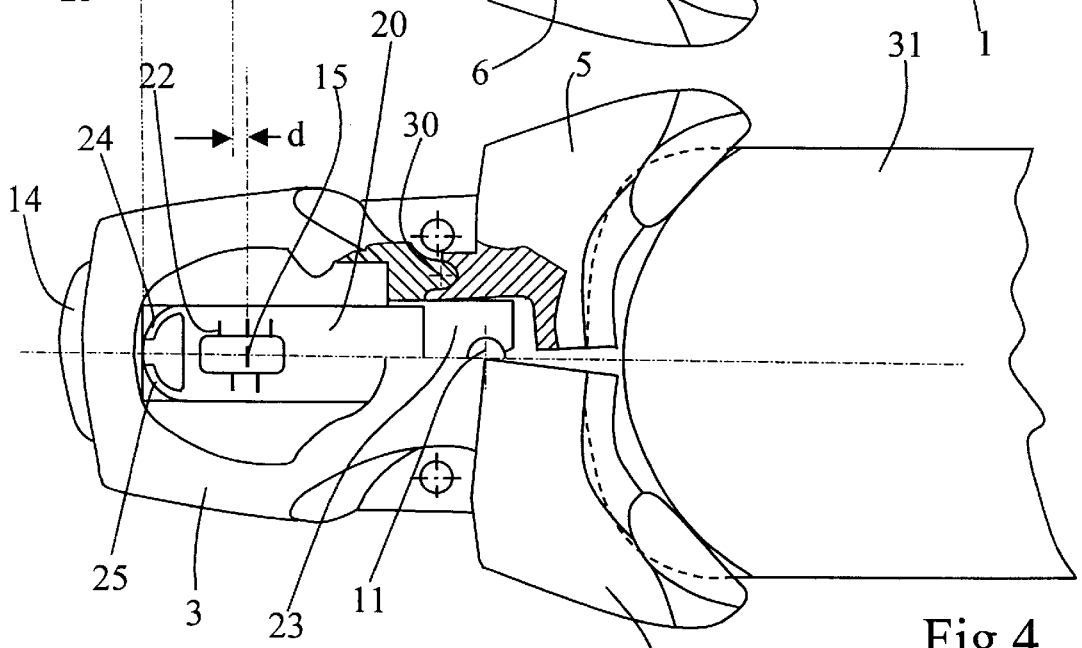
Fig.4
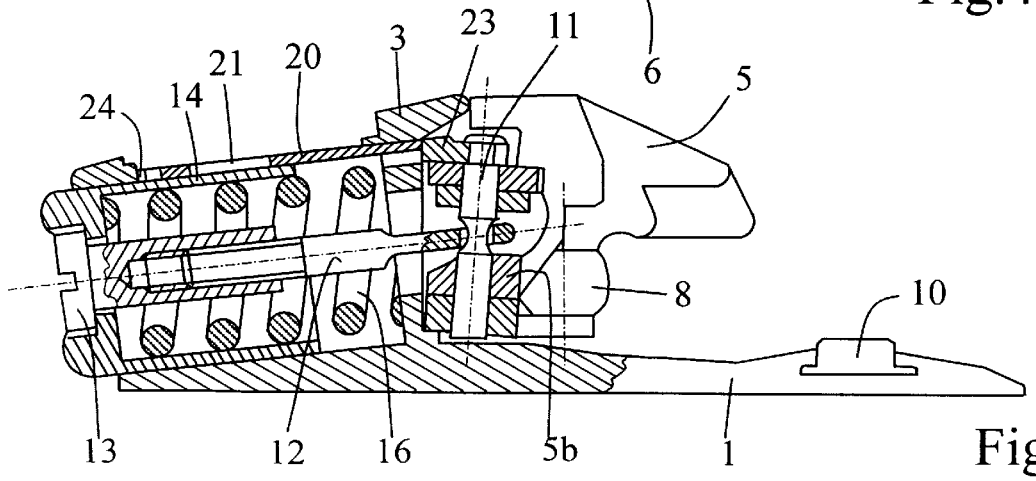
Fig.5

SAFETY BINDING FOR THE FRONT END OF A BOOT

FIELD OF THE INVENTION

The invention relates to a ski-boot safety binding intended to hold the front end of a boot and release it when subjected to forces exceeding a predetermined threshold, comprising a binding body, a jaw consisting of two arms which are mounted in order to pivot independently of one another so that they can move away from one another, and form levers which act on one of the ends of a rod, the other end of which is connected to a stop which is secured to the rod and can have its position on the rod adjusted, and a spring which works in compression between the stop secured to the rod and a fixed stop and whose preload can be adjuster using the stop secured to the rod, this stop having, to display the value of the preload of the spring, an index which cooperates with a graduation on a part linked in translation with the rod at least when the boot is being engaged.

PRIOR ART

Linking the graduation in translation with the rod makes it possible to avoid the user being subjected to a modification in the value of the display of the preload of the spring, that is to say the value of the release threshold of the binding, when the boot is being engaged. The explanation for this is that, when the boot is being engaged in a binding of this type, it moves the arms of the jaw apart slightly, so that it bears against the ends of these arms and against front stop means. This separation of the arms induces tension on the rod, and this moves the index secured to the rod. If the part bearing the graduation were fixed, the display of the value of the preload of the spring would become modified by this, which would be annoying to the user. Further, it would be possible to check the desired preload only when the boot is disengaged.

A binding of this type is known from Patent DE 27 56 895 and U.S. Pat. No. 4,170,379. In this binding, the part bearing the graduation consists of a metal angle piece riveted to one end of the rod.

The object of the invention is to replace an angle piece of this type, which is relatively heavy and bulky, by a part which is lightweight and therefore simpler to fit.

SUMMARY OF THE INVENTION

For this purpose, the binding according to the invention is one wherein the part which bears the graduation consists of a plate which bears, longitudinally, via one of its ends, against a part which is linked in translation with the rod and, by its other end, against the binding body via an elastic means.

A plate of this type, particularly if it is made of plastic, is a lightweight and compact part. It is simple to install and does not require any particular fastening means.

The elastic means preferably consists of one or two tongues integral with the plate.

The elastic travel of the plate may be relatively short, because it is sufficient for the plate to be linked in translation with the rod merely when the boot is being engaged, given that the skier has no need or practical opportunity to read the display of the value of the compression of the spring during release or pre-release of the binding.

BRIEF DESCRIPTION OF THE DRAWINGS

The appended drawing represents an embodiment of the invention by way of example.

FIG. 1 is a perspective view.

FIG. 2 shows the interior of the body of the binding, this body and the baseplate being represented in vertical axial section.

FIG. 3 is a plan view, from above, of the binding before the boot has been engaged.

FIG. 4 is a plan view of the binding after the boot has been engaged.

FIG. 5 is a view in section on V—V in FIG. 3.

DESCRIPTION OF THE PREFERRED EMBODIMENT

The binding which is represented comprises a base 1 provided with holes 2 for fastening it to the ski using four screws. This base is secured to a binding body 3. A jaw is mounted on the body 1, and consists of two arms 5 and 6 which are mounted in order to pivot independently of one another about two separate vertical axes 30 arranged symmetrically one on either side of the vertical plane of symmetry 7 of the binding, to make it possible for them to move away from one another and bear, via their end parts 5*a* and 6*a*, against the upper of the boot, on each side of the end thereof. These arms are further provided, close to their pivot axis, with a roller 8 which serves as a front stop for the end of the sole of the boot. At the rear of the base 1 it is possible to see, only in FIG. 1, a support 9 on which a slide 10 is mounted which can move transversely and elastically and serves as a vertical support for the sole of the boot.

The arms 5 and 6 constitute levers of the first class, of which the ends opposite the ends 5*a* and 6*a*, for example the end 5*b* which can be seen in FIG. 2, are articulated to a vertical pin 11 passing through the end 12*a* of a rod 12, the other end of which is screw-threaded and bears a tubular screw-headed nut 13 bearing on a bush-shaped stop 14 which has an index 15 on its top. A coil spring 16 which works in compression between the moving stop, consisting of the bottom of the bush 14 and a fixed stop 17 formed by a transverse wall of the base 1, is mounted around the rod 12. Separation of the arms 5 and 6 therefore has the effect of exerting tension on the rod 12 and consequently compressing the spring 16 and moving the index 15. This design is described in detail in Patent EP 0 295 372.

In its upper face, the binding body 3 has a recess 18, in the bottom of which a window closed by a longitudinal rectangular cutout 19 is formed. A plastic plate 20, itself having an oblong cutout 21 which extends above the index 15 and one of the edges of which is provided with a graduation 22 for reading the position of the index 15, is mounted in this cutout. The back end of the plate 20 bears against a part 23 through which the pin 11 passes and which is consequently linked in translation with the rod 12. The front end of the plate 20 has two converging flexible tongues 24 and 25 which bear, in elastic flexion, against the front edge of the window 19, that is to say on the binding body 3. The tongues 24 and 25 are integral with the plate 20.

A transparent part 26 which hermetically covers the window 19 and makes it possible to read the display of the preload of the spring 16 is fixed in the recess 18.

The preload of the spring 16, which determines the resistance of the binding to being released, that is to say its degree of hardness, is brought about using the screw 13. This preload be read on the plate 20.

When the boot 31 is being engaged, it moves the arms 5 and 6 apart slightly, as can be seen in FIG. 4. This separation has the effect of exerting tension on the rod 12 and consequently of moving the index 15 by a value d. Since the rear stop part 23 of the plate 20 moves with the rod, the plate 20 follows the rod while being pushed by the tongues 24 and 25. The stop 14 and the plate 20 both move with the rod 12, and the display of the preload is not modified when the boot is being engaged.

It should be pointed out that it is sufficient for the plate 20 to follow the movement of the rod when the boot is being engaged. The reason for this is that it is not necessary to read the setting of the hardness of the binding when the rod moves owing to a force on the arms 5 or 6 due to the boot twisting, since such a reading is entirely superfluous and virtually impossible. A relatively small elastic travel of the plate 20 is therefore sufficient, and so the tongues 24 and 25 are entirely satisfactory for providing this elastic travel and linking the plate 20 in translation with the rod 12.

It would, however, clearly be possible to provide an elastic element separate from the plate 20 instead of the tongues 24 and 25.

The plate 20 may be made of plastic, metal or any other suitable material.

What is claimed is:

1. A ski-boot safety binding intended to hold a front end of a boot and release it when subjected to forces exceeding a predetermined threshold, comprising a fixed binding body (3) bearing a jaw consisting of two arms (5, 6) which are mounted in order to pivot independently of one another so that they can move away from one another, and form levers which act on one **(12*a*) of the ends of a rod (12), the other end of which is connected to a stop (14) which is secured to the rod and can have its position on the rod adjusted, and a spring (16) which works under a preload in compression between the stop (14) secured to the rod and a fixed stop (17) and whose preload can be adjusted by the stop secured to the rod, this stop having, to display the value of the preload of the spring, an index (15) which cooperates with a graduation (22) on a part which translates with the rod at least when the boot is being engaged, wherein the part which bears the graduation consists of a plate (20) which bears, longitudinally, via one of its ends, against a part (23) which translates with the rod and, by its other end, against the binding body via an elastic means (24, 25)**.

2. The binding as claimed in claim 1, wherein the elastic means consists of two flexible tongues (24, 25) integral with the plate (20).

* * * * *

UNITED STATES PATENT AND TRADEMARK OFFICE

CERTIFICATE OF CORRECTION

PATENT NO : 6,053,523

DATED : APRIL 25, 2000

INVENTOR(S) : QUILLARD et al.

It is certified that error appears in the above-identified patent and that said Letters Patent are hereby corrected as shown below:

Col. 1, line 15, replace "adjuster" by -adjusted--;

Col. 2, line 64, insert after "preload" -can--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,053,523
DATED : April 25, 2000
INVENTOR(S) : Quillard et al.

It is certified that error appears in the above-identified patent and that said Letters Patent is hereby corrected as shown below:

Column 1,
Line 15, replace "adjuster" by -- adjusted --;

Column 2,
Line 64, insert after "preload" -- can --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*